US010219058B2

(12) United States Patent
Hung et al.

(10) Patent No.: US 10,219,058 B2
(45) Date of Patent: Feb. 26, 2019

(54) ELECTRONIC DEVICE HAVING L-SHAPED SOUND CHANNEL AND METHOD FOR MANUFACTURING THE SAME

(71) Applicant: Chiun Mai Communication Systems, Inc., New Taipei (TW)

(72) Inventors: Ching-Ming Hung, New Taipei (TW); Yi-Chieh Miao, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 0 days.

(21) Appl. No.: 16/049,825

(22) Filed: Jul. 31, 2018

(65) Prior Publication Data

US 2019/0037294 A1 Jan. 31, 2019

(30) Foreign Application Priority Data

Jul. 31, 2017 (CN) ..... 2017 1 0643656

(51) Int. Cl.
*H04R 1/02* (2006.01)
*H04R 1/28* (2006.01)

(52) U.S. Cl.
CPC ..... *H04R 1/025* (2013.01); *H04R 1/023* (2013.01); *H04R 1/2857* (2013.01); *H04R 2400/11* (2013.01); *H04R 2499/11* (2013.01)

(58) Field of Classification Search
CPC .... H04R 1/025; H04R 2499/11; H04R 1/023; H04R 1/2857; H04R 2400/11
USPC ..... 381/333
See application file for complete search history.

(56) References Cited

U.S. PATENT DOCUMENTS

2014/0153769 A1* 6/2014 Chen ..... H04R 1/28 381/394

FOREIGN PATENT DOCUMENTS

CN 204795204 U 11/2015
TW 201421204 6/2014

* cited by examiner

*Primary Examiner* — Paul S Kim
(74) *Attorney, Agent, or Firm* — ScienBiziP, P.C.

(57) ABSTRACT

An electronic device with a full-screen display and L-shaped sound channel is disclosed. The device includes a display, a cover, a frame and a sound assembly. The frame includes bottom and side walls, and the sound assembly includes a sound output hole, a sound channel and a sound generating module. The sound output hole is defined between a notch of the cover and the side wall. The sound channel is formed in the frame and includes first and second channels. The first channel is formed by horizontal cutting and the second channel is formed by vertical cutting. The first and second channels are interconnected and communicate with the sound output hole. Sound generated by the sound generating module is transmitted to the sound output hole through the sound channel. A method for manufacturing the electronic device is also disclosed.

12 Claims, 7 Drawing Sheets

ELECTRONIC DEVICE HAVING L-SHAPED SOUND CHANNEL AND METHOD FOR MANUFACTURING THE SAME

FIELD

The disclosure generally relates to electronic devices and manufacturing methods therefor, and particularly to an electronic device with a full-screen (i.e. narrow-bezel) display and L-shaped sound channel and a method for manufacturing the electronic device.

BACKGROUND

Screens of current mobile phones are getting larger as the mobile phones become thinner and thinner. Due to the complex structure of the traditional moving coil receiver, it is difficult to fit such receiver in a thinner mobile phone. Full-screen (i.e. narrow bezel) mobile phones generally use a piezoelectric receiver for the purposes of miniaturization and thinness, and use bone conduction technology for sound transmission. However, piezoelectric receivers using bone conduction technology are generally expensive.

BRIEF DESCRIPTION OF THE DRAWINGS

Many aspects of the present disclosure can be better understood with reference to the drawings. The components in the drawings are not necessarily drawn to scale, the emphasis instead being placed upon clearly illustrating the principles of the disclosure. Moreover, in the drawings, like reference numerals designate corresponding parts throughout the views.

DETAILED DESCRIPTION

Figure 1:
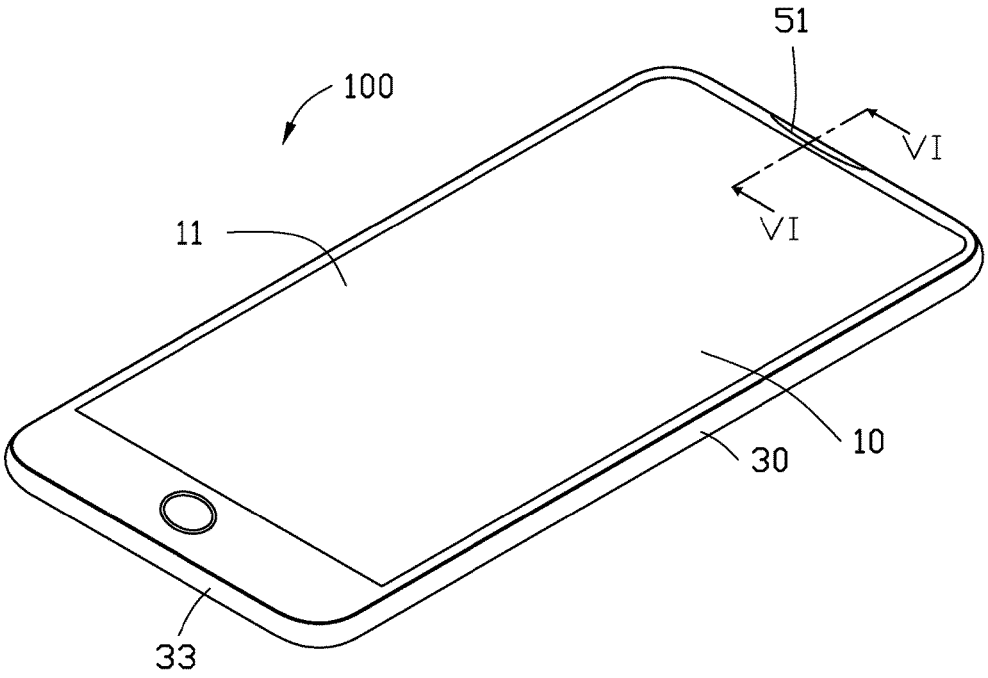
FIG. 1 is an isometric view of an electronic device, according to an exemplary embodiment.

It will be appreciated that for simplicity and clarity of illustration, where appropriate, reference numerals have been repeated among the different figures to indicate corresponding or analogous elements. In addition, numerous specific details are set fourth in order to provide a thorough understanding of the embodiments described herein. However, it will be understood by those of ordinary skill in the art that the embodiments described herein can be practiced without these specific details. In another instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "substantially" is defined to be essentially conforming to the particular dimension, shape, or another feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

FIG. 1 is an isometric view of an electronic device 100, according to an exemplary embodiment. The electronic device 100 can be, but is not limited to, a mobile phone, a personal digital assistant (PDA), or a tablet computer. In this embodiment, the electronic device 100 is a mobile phone. The electronic device 100 includes a cover 10, a frame 30, and a sound assembly 50.

Figure 2:
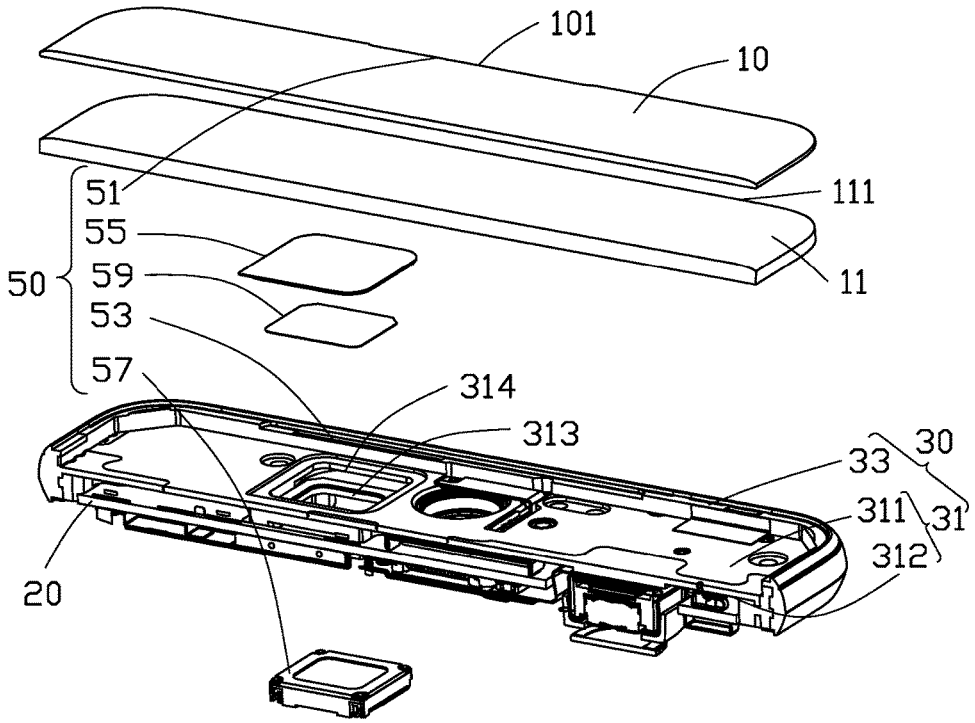
FIG. 2 is a partial, disassembled view of the electronic device of FIG. 1.
Figure 3:
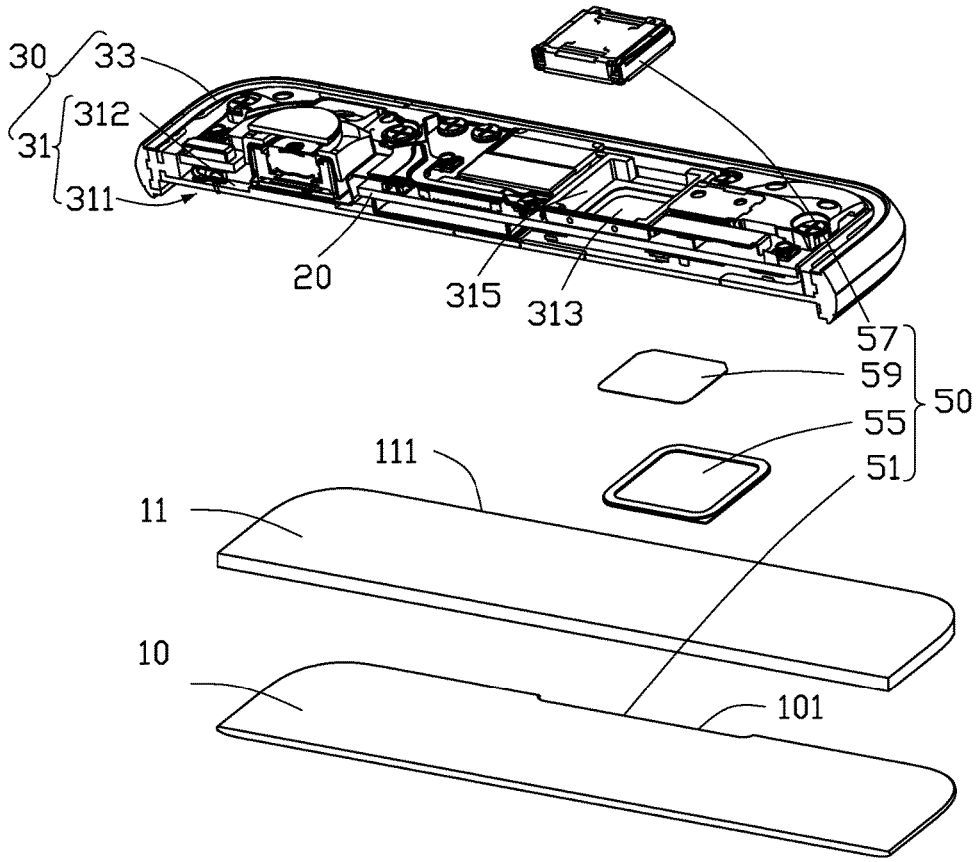
FIG. 3 is similar to FIG. 2, but shown from another aspect.

Referring to FIGS. 2 and 3, in this exemplary embodiment, the cover 10 can be a front cover of the electronic device 100. A display 11 is positioned under the cover 10. The cover 10 can be a glass cover, including at least one transparent region positioned over a display region of the display 11.

The frame 30 can be a middle frame of the electronic device 100. The frame 30 includes a bottom wall 31 and a plurality of side walls 33 extending from a peripheral edge of the bottom wall 31. The bottom wall 31 includes a first surface 311 and a second surface 312 opposite to the first surface 311. The cover 10 and the display 11 of the electronic device 100 are assembled to the first surface 311. A circuit board 20, a battery (not shown), and a rear cover 40 (shown in FIG. 4) of the electronic device 100 are assembled to the second surface 312. A through hole 313 is defined between the first surface 311 and the second surface 312 in the bottom wall 31. A first recess 314 (shown in FIG. 2) is formed on the first surface 311 corresponding to the through hole 313. A second recess 315 (shown in FIG. 3) is formed on the second surface 312 corresponding to the through hole 313.

The sound assembly 50 includes a sound output hole 51, a sound channel 53, a sealing member 55, and a sound generating module 57.

Referring to FIG. 1, the sound output hole 51 is defined and surrounded by a notch 101, which is formed in an edge of the cover 10, and one of the side walls 33. The sound output hole 51 is positioned at a gap G (shown in FIG. 4) between a side edge 111 of the display 11 and one of the side walls 33. A width of the gap G is less than 1.5 mm, and thus the electronic device 100 is a full-screen or narrow bezel electronic device 100. A width of the sound output hole 51 is less than 1 mm. In an exemplary embodiment, the width of the sound output hole 51 is about 0.7 mm.

Figure 4:
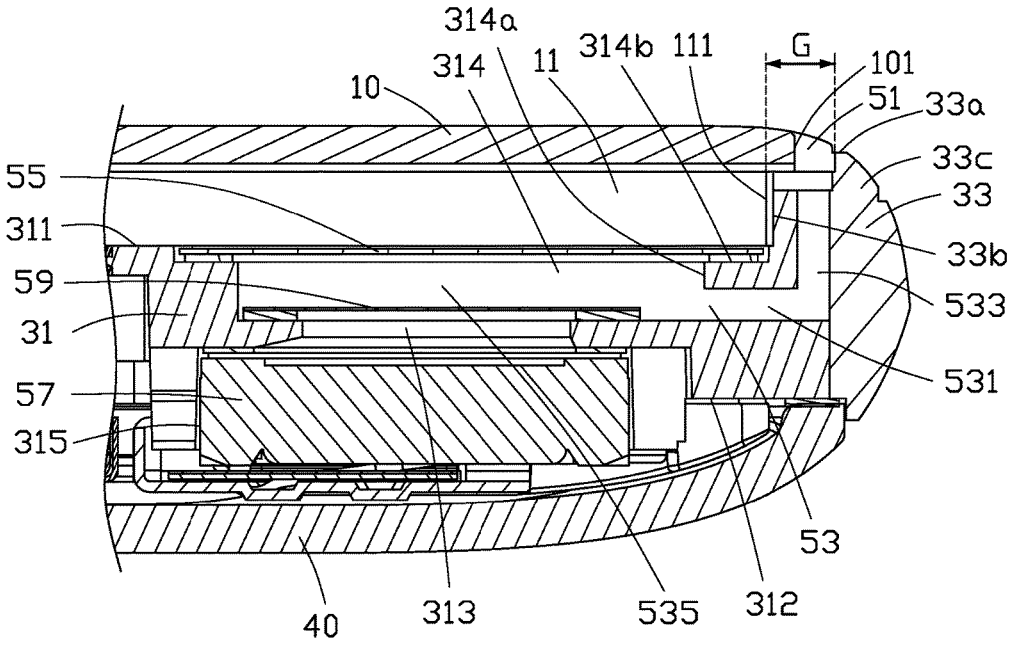
FIG. 4 is a cross-sectional view of the electronic device of FIG. 1 along line VI-VI, according to an exemplary embodiment.

Referring to FIG. 4, the sound channel 53 is formed in the frame 30 and communicates with the sound output hole 51. In this exemplary embodiment, the sound channel 53 includes a first channel 531, a second channel 533, and a third channel 535. The first channel 531 is formed by horizontally cutting from an inner surface 314*a* (which is closest to the one of the side walls 33) of the first recess 314 towards the closest side wall 33, and is substantially parallel to a display plane of the display 11.

The second channel 533 is formed by vertically cutting from an upper surface 33*a* of the one of the side walls 33 towards the bottom wall 31. The second channel 533 communicates with the first channel 531, and forms an L-shaped sound channel together with the first channel 531. The second channel 533 is substantially parallel to the side edge 111 of the display 11.

The sealing member 55 is positioned on a notch 314*b* of the first recess 314, and seals the first recess 314. An upper surface of the sealing member 55 is substantially coplanar with the first surface 311 of the bottom wall 31.

The sound generating module 57 can be a receiver. The sound generating module 57 is disposed in the second recess 315 and corresponds to the through hole 313. A third channel 535 is formed between the sound generating module 57 and the sealing member 55 via the through hole 313. The third channel 535 communicates with the first channel 531. Sound generated by the sound generating module 57 is transmitted to the L-shaped sound channel through the through hole 313 and the third channel 535 and is finally transmitted to outside from the sound output hole 51. In another exemplary embodiment, the sound generating module 57 can be assembled to the second surface 312 by latching structures (not shown) so as to correspond to the through hole 313, and is not limited to being received in a recess (e.g. the second recess 315).

In another exemplary embodiment, the sound module 50 further includes a dust screen 59. The dust screen 59 is assembled to the through hole 313 to prevent dust and other debris from entering into the sound generating module 57.

In this exemplary embodiment, the frame 30 is formed by combining a non-metallic material (such as rubber or plastic material) with a metal substrate by an injection molding process. Referring to FIG. 2 and FIG. 4, a portion of the bottom wall 31 and an inner side wall 33*b* of one of the side walls 33 are made of the non-metallic material, and the first recess 314 and the second recess 315 are formed and defined by the non-metallic material. An outer side wall 33*c* of the one of the side walls 33 is made of metal material. The bottom wall 31, the first recess 314, the second recess 315, and the inner side wall 33*b* of one of the side wall 33 are formed and seamlessly combined with the outer side wall 33*c* by the injection molding process, and the first channel 531 and the second channel 533 are defined and formed in the non-metallic material.

In another exemplary embodiment, the frame 30 can be made entirely of non-metallic material or entirely of metal material. The non-metallic material portion of the frame 30 can be used to form a clearance area of the electronic device 100 for an antenna.

To assemble the electronic device 100 to form the above sound assembly 50, the assembling method mainly includes at least the following steps. Firstly, the dust screen 59 is disposed above the through hole 313. Then, the sealing member 55 is disposed in the first recess 314. The sound generating module 57 is disposed in the second recess 315. Afterwards, the display 11 is disposed on the first surface 311 and covers the sealing member 55. The cover 10 is assembled to the frame 30 and attached on the display 11. The sound output hole 51 is formed between the notch 101 and the side wall 33. The sound output hole 51 corresponds to the second channel 533, and communicates with the L-shaped sound channel. In use, the sound generated by the sound generating module 57 is transmitted to the L-shaped sound channel through the through hole 313 and the third channel 535, and is transmitted to the outside from the sound output hole 51.

Figure 5A:
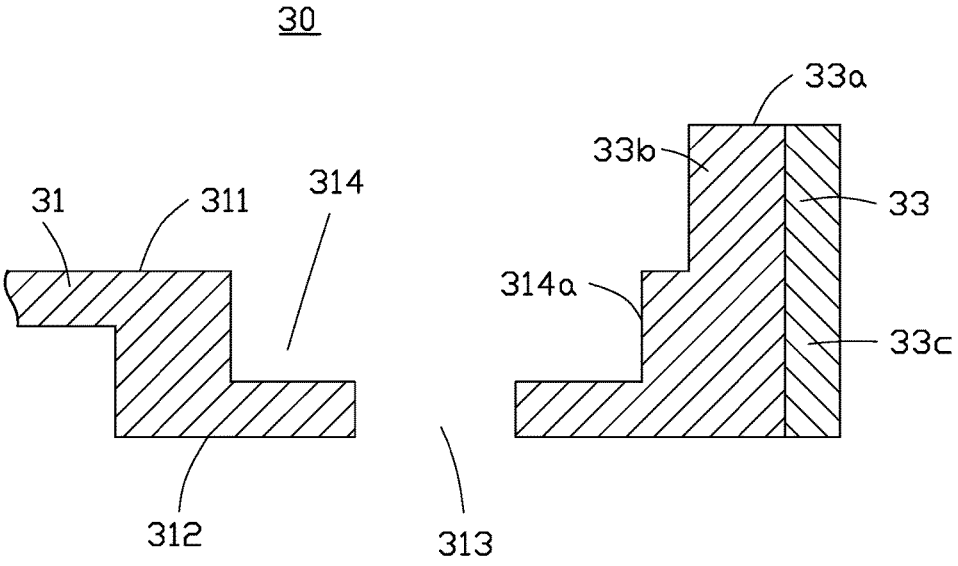
FIGS. 5A, 5B, and 5C are views illustrating a method for manufacturing the electronic device of FIG. 1, according to an exemplary embodiment.
Figure 5B:
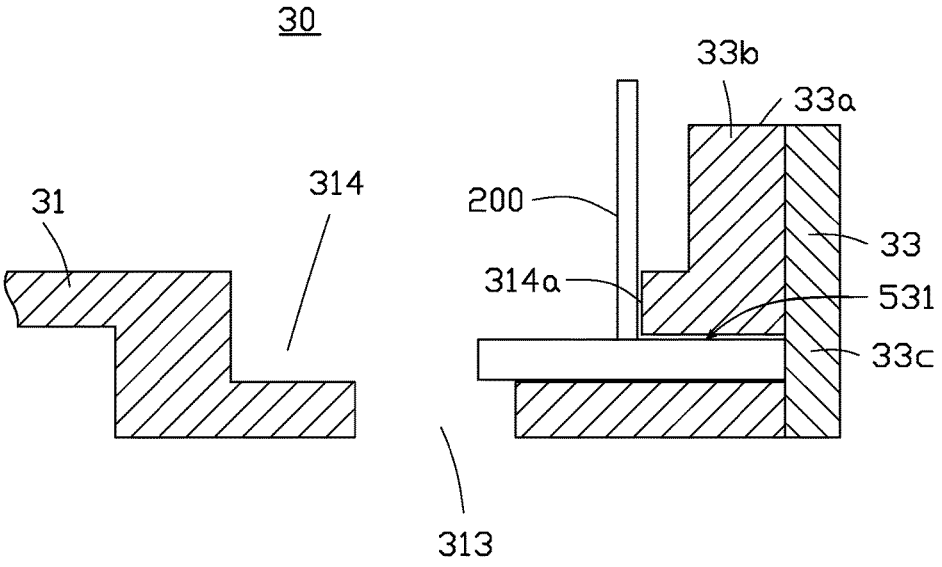
Figure 5C:
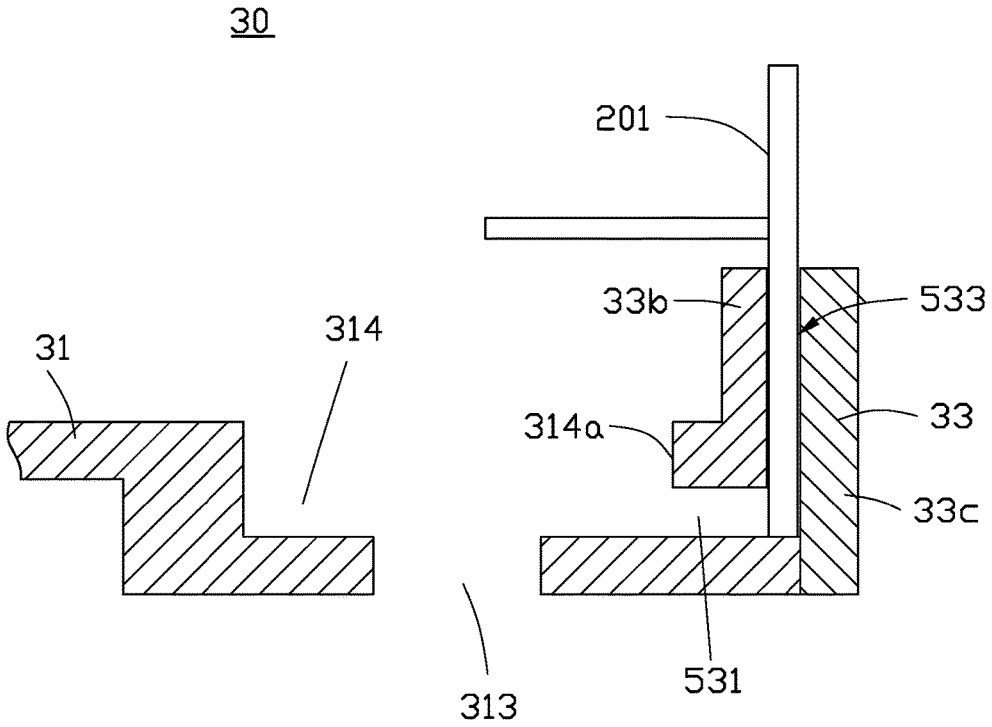
Figure 6:
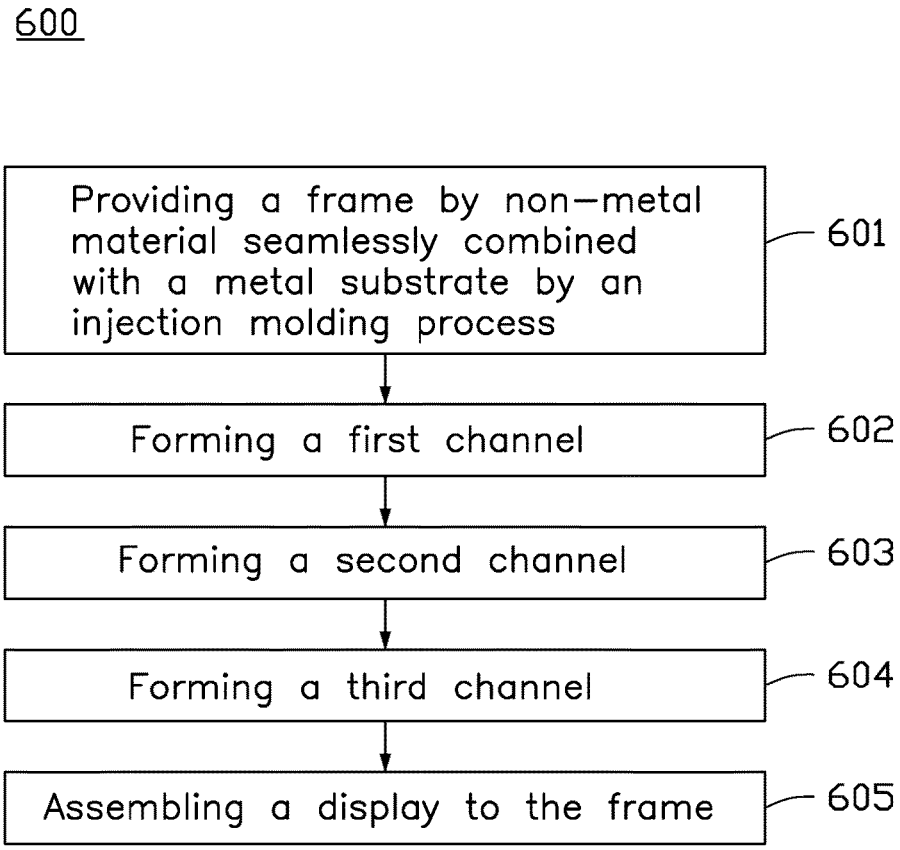
FIG. 6 is a flowchart of a method for manufacturing the electronic device of FIG. 1, according to an exemplary embodiment.

FIG. 5A, FIG. 5B, and FIG. 5C illustrate example steps of forming the L-shaped sound channel of FIG. 4. Referring to FIG. 6, a flowchart is presented in accordance with an example embodiment of a manufacturing method. The example method 600 is provided by way of example, as there are a variety of ways to carry out the method. Each block shown in FIG. 6 represents one or more processes, methods or subroutines, carried out in the method 600. Additionally, the illustrated order of blocks is by example only and the order of the blocks can change. The method 600 can begin at block 601.

At block 601, a frame 31, which is formed by combining a non-metallic material (such as rubber or plastic material) with a metal substrate by an injection molding process, is provided as shown in FIG. 5A. The frame 30 at least includes a bottom wall 31, a first recess 314, and a side wall 33. The side wall 33 extends from a peripheral edge of the bottom wall 31 to form a loop-shaped side frame of the electronic device 100, as shown in FIG. 1. The side wall 33 has an inner side wall 33*b* made of the non-metallic material (e.g. rubber or plastic material) and an outer side wall portion 33*c* made of metal material. The inner side wall 33*b* and the outer side wall 33*c* are combined together by the injection molding process to form the side wall 33. The bottom wall 31 is integrally connected to the inner sidewall 33*b* by the injection molding process. The bottom wall 31 includes a first surface 311, a second surface 312 opposite to the first surface 311, a through hole 313 defined between the first surface 311 and the second surface 312, and a first recess 314 defined in the first surface 311 and communicating with the through hole 313. The through hole 313 is defined in the first recess 314.

At block 602, a first cutting tool 200 is used to horizontally cut from an inner surface 314*a* of the first recess 314 towards the side wall 33. Such cut forms the first channel 531, as shown in FIG. 5B.

At block 603, a second cutting tool 201 is used to vertically cut from an upper surface of the inner wall 33*b* towards the bottom wall 31. This cut forms the second channel 533 communicating with the first channel 531, so as to form an L-shaped sound channel, as shown in FIG. 5C. In this exemplary embodiment, the first cutting tool 200 and the second cutting tool 201 may be the same tool or different tools.

It should be noted that FIG. 5A, FIG. 5B, and FIG. 5C are merely for illustrating the steps of forming the L-shaped sound channel, but a shape of the frame 30 as disclosed in the drawings is not intended to limit, the present disclosure. After the L-shaped sound channel is formed, the method for manufacturing the electronic device 100 further includes the following steps.

Also referring to FIG. 4, a sealing member 55 is closely attached to the notch 314*b* of the first recess 314.

At block 604, a sound generating module 57 is disposed in the second recess 315 of the second surface 312. A third channel 535 is formed between the sound generating module 57 and the sealing member 55 via the through hole 313. The third channel 531 communicates with the first channel 531. In this exemplary embodiment the first recess 314 and the second recess 315 are formed respectively on the first surface 311 and the second surface 312 by the above-mentioned injection molding process using the non-metallic material.

At block 605, a display 11 is disposed on the first surface 311 of the bottom wall 31 and covers the sealing member 55, wherein the display 11 has a cover 10 attached thereon. A sound output hole 51 is formed between a notch 101 of the cover 10 and the side wall 33. The sound output hole 51 is positioned above the second channel 533 to communicate with the L-shaped sound channel.

The frame 30 and one of its side walls 33 are formed by seamlessly, combining the non-metallic material with the metal substrate, and the second channel 533 is formed in the inner sidewall 33*b* made of the non-metallic material.

The sound channel of the electronic device 100 is formed in the frame 30, and the corresponding sound hole 51 is formed in the gap G between the side edge 111 and one of the side walls 33 of the display 11. Thus, the electronic device 100 can still accommodate a full-sized screen and be manufactured with a lower manufacturing cost. In this exemplary embodiment, the full-sized screen is defined in terms of an interval, which is less than a predetermined distance, between one display edge of the display 11 and the side wall 33. Such predetermined distance is preferably less than 2 mm, but it is not limited thereto in the present disclosure.

It is to be understood, however, that even through numerous characteristics and advantages of the present disclosure have been set forth in the foregoing description, together with details of assembly and function, the disclosure is illustrative only, and changes may be made in details, especially in the matters of shape, size, and arrangement of parts within the principles of the disclosure to the full extent indicated by the broad general meaning of the terms in which the appended claims are expressed.

What is claimed is:

1. An electronic device, comprising:
- a display;
- a cover, attached to the display and defining a notch;
- a frame, comprising:
  - a bottom wall, comprising a first surface and a second surface opposite to the first surface, wherein the bottom wall defines a through hole, and the first surface defines a first recess corresponding to the through hole; and
  - a side wall, extending from a peripheral edge of the bottom wall;
- a sound assembly, comprising:
  - a sound output hole, defined and surrounded by the notch and the side wall;
  - a sound channel, formed in the frame and comprising a first channel and a second channel, wherein the first channel is formed by horizontally cutting from an inner surface of the first recess towards the side wall, the second channel is formed by vertically cutting from an upper surface of the side wall towards the bottom wall, and the second channel communicates with the first channel to form an L-shaped sound channel communicating with the sound output hole;
  - a sealing member, positioned on the first recess and sealing the first recess; and
  - a sound generating module, positioned on the second surface and corresponding to the through hole, wherein sound generated by the sound generating module is transmitted to the sound output hole through the through hole and the L-shaped sound channel.

2. The electronic device of claim 1, wherein the sound output hole is positioned at a gap between a side edge of the display and the side wall of the frame, a width of the gap is less than 1.5 mm, and a width of the sound output hole is less than 1 mm.

3. The electronic device of claim 1, wherein an upper surface of the sealing member is substantially coplanar with the first surface of the bottom wall, and the display is disposed on the first surface and covers the sealing member.

4. The electronic device of claim 1, wherein the first channel is substantially parallel to the display.

5. The electronic device of claim 1, wherein the sound channel further comprises a third channel formed between the sound generating module and the sealing member via the through hole, the third channel communicates with the first channel, and sound generated by the sound generating module is transmitted to the L-shaped sound channel through the third channel.

6. The electronic device of claim 1, wherein the sound assembly further comprises a dust screen, and the dust screen is assembled to the through hole.

7. The electronic device of claim 1, wherein the side wall comprises an inner side wall made of non-metallic material and an outer side wall made of metal material, the inner side wall is combined with the outer side wall by an injection molding process to form the side wall, the bottom wall is integrally connected to the inner side wall by the injection molding process, the second channel is formed in the inner side wall made of the non-metallic material.

8. The electronic device of claim 7, wherein the first recess is formed on the first surface by the injection molding process using the non-metallic material.

9. A method for manufacturing an electronic device with an L-shaped sound channel, comprising:
- providing a frame comprising a bottom wall and a side wall extending from a peripheral edge of the bottom wall, wherein the bottom wall comprises a first surface and a second surface opposite to the first surface and defines a through hole, and the first surface defines a first recess corresponding to the through hole;
- horizontally cutting from an inner surface of the first recess towards the side wall to form a first channel;
- vertically cutting from an upper surface of the side wall towards the bottom wall to form a second channel, wherein the second channel communicates with the first channel to form the L-shaped sound channel; and
- providing a sound generating module and disposing the sound generating module on the second surface to correspond to the through hole, wherein sound generated by the sound generating module is transmitted to the sound output hole through the through hole and the L-shaped sound channel.

10. The method of claim 9, further comprising:
- closely attaching a sealing member to the first recess; and
- forming a third channel between the sound generating module and the sealing member via the through hole, wherein the third channel communicates with the first channel.

11. The method of claim 10, further comprising:
- disposing a display on the first surface with the display covering the sealing member, wherein the display has a cover attached thereon, and the cover has a notch formed in an edge thereof; and
- forming a sound output hole between the notch and the side wall, wherein the sound output hole is positioned above the second channel to communicate with the L-shaped sound channel.

12. The method of claim 9, wherein the step of providing the frame further comprising:
- seamlessly combining non-metallic material with a metal substrate by an injection molding process to form the frame and the side wall, wherein the second channel is formed in the inner side wall made of the non-metallic material.

* * * * *